US012422233B2

(12) United States Patent
Berg et al.

(10) Patent No.: US 12,422,233 B2
(45) Date of Patent: Sep. 23, 2025

(54) PENETRATOR, USE OF A PENETRATOR, PROJECTILE AND CARTRIDGE AMMUNITION

(71) Applicant: Rheinmetall Waffe Munition GmbH, Südheide (DE)

(72) Inventors: Martin Berg, Celle (DE); Michael Gowin, Hermannsburg (DE); Christian Baumann, Martinsrieth (DE); Alfons Sackarndt, Suderburg (DE)

(73) Assignee: Rheinmetall Waffe Munition GmbH, Südheide (DE)

( * ) Notice: Subject to any disclaimer, the term of this patent is extended or adjusted under 35 U.S.C. 154(b) by 0 days.

(21) Appl. No.: 18/672,303

(22) Filed: May 23, 2024

(65) Prior Publication Data

US 2024/0328765 A1 Oct. 3, 2024

Related U.S. Application Data

(63) Continuation of application No. PCT/EP2022/082675, filed on Nov. 21, 2022.

(30) Foreign Application Priority Data

Nov. 25, 2021 (DE) ..... 10 2021 130 961.1

(51) Int. Cl.
*F42B 12/06* (2006.01)

(52) U.S. Cl.
CPC ..... *F42B 12/06* (2013.01)

(58) Field of Classification Search
CPC ..... F42B 12/06
See application file for complete search history.

(56) References Cited

U.S. PATENT DOCUMENTS

| | | | | |
|---|---|---|---|---|
| 4,635,556 | A | 1/1987 | Boecker et al. | |
| 4,823,703 | A * | 4/1989 | Donaldson | F42B 12/06 102/521 |
| 6,378,435 | B1 | 4/2002 | Bai et al. | |
| 9,909,848 | B2 | 3/2018 | Bootes et al. | |
| 2006/0054047 | A1 | 3/2006 | Burri | |

(Continued)

FOREIGN PATENT DOCUMENTS

| | | |
|---|---|---|
| DE | 32 09 593 A1 | 9/1983 |
| DE | 39 19 172 A1 | 12/1990 |

(Continued)

OTHER PUBLICATIONS

Search Report from corresponding German Patent Application No. 10 2021 130 961.1, dated Jul. 7, 2022.

(Continued)

*Primary Examiner* — Jonathan C Weber

(57) ABSTRACT

The invention relates to a penetrator for a projectile, in particular a sub-caliber kinetic energy projectile, wherein the penetrator has a terminal-ballistic body for attacking an armored target, wherein a hole is formed in the body, which extends along or parallel to the central longitudinal axis of the body entirely or along a predominant portion of the length of the body, wherein at least one exactly fitting insert part is introduced into the hole, which has a through-opening extending along or parallel to the central longitudinal axis of the insert part for guiding through an electrical or electronic line.

17 Claims, 5 Drawing Sheets

(56) References Cited

U.S. PATENT DOCUMENTS

| | | | |
|---|---|---|---|
| 2006/0090662 | A1 | 5/2006 | Biggs |
| 2016/0363426 | A1 | 12/2016 | Kerns et al. |
| 2018/0224251 | A1 | 8/2018 | Berg |
| 2021/0404782 | A1 | 12/2021 | Treadway et al. |
| 2022/0333907 | A1 | 10/2022 | Berg |

FOREIGN PATENT DOCUMENTS

| | | | | | |
|---|---|---|---|---|---|
| DE | 34 32 650 | C2 | | 7/1995 | |
| DE | 10 2013 014 665 | B3 | | 4/2014 | |
| DE | 10 2015 117 018 | A1 | | 4/2017 | |
| DE | 10 2019 121 984 | A1 | | 2/2021 | |
| EP | 3 377 844 | B1 | | 5/2019 | |
| GB | 2138549 | A | * | 10/1984 | ..... F42B 10/46 |
| WO | WO-2006136185 | A1 | * | 12/2006 | ..... F42B 12/204 |
| WO | WO-2016/022199 | A1 | | 2/2016 | |

OTHER PUBLICATIONS

International Search Report from corresponding PCT Application No. PCT/EP2022/082675, dated Feb. 14, 2023.

Written Opinion from the International Searching Authority from corresponding PCT Application No. PCT/EP2022/082675, dated Feb. 14, 2023.

* cited by examiner

PENETRATOR, USE OF A PENETRATOR, PROJECTILE AND CARTRIDGE AMMUNITION

CROSS-REFERENCE TO RELATED APPLICATIONS

This application is a continuation application of PCT Application No. PCT/EP2022/082675, filed on 21 Nov. 2022, which claims the benefit of and priority to German Patent Application No. 10 2021 130 961.1, filed on 25 Nov. 2021. The entire disclosures of the applications identified in this paragraph are incorporated herein by references.

FIELD

The invention relates to a penetrator for a projectile, in particular a sub-caliber kinetic energy projectile. The penetrator has a terminal-ballistic body for attacking an armored target, in particular a tank.

BACKGROUND

The invention also relates to the use of such a penetrator to attack an armored target, in particular a tank. The invention also relates to a projectile with a sabot and such a penetrator. Finally, the invention relates to a cartridge ammunition comprising a cartridge case and such a projectile.

A penetrator can be used to create a sub-caliber kinetic energy projectile that achieves its effect through kinetic energy. Such projectiles are usually fired directly at a target by tanks or artillery weapons with large-caliber guns.

A penetrator of the type mentioned above is known from DE 10 2019 121 984 A1. This penetrator has an outer body with a hollow cross section and a core arranged inside. This allows a penetrator with a high bending stiffness to be formed without having to increase the weight of the penetrator, e.g., the DM53 or DM63 design of applicant. However, this penetrator is not yet sufficiently suitable for equipping with electrical properties. Therefore, there is potential for optimization.

SUMMARY

The object of the invention is to provide a penetrator that is improved in comparison. It is particularly desirable that a channel can be formed quickly and efficiently in the penetrator in order to feed an electrical or electronic line through the penetrator.

The invention achieves this object by a penetrator having the features of claim 1.

The penetrator is designed and/or intended for a projectile, in particular a sub-caliber kinetic energy projectile. The penetrator has a terminal-ballistic body or penetrator body for attacking an armored target. A bore is formed in the body, in particular in the form of a deep hole, which extends entirely or over the predominant portion of the length of the body, along or parallel to the central longitudinal axis of the body. One or more exactly fitting insert parts are introduced into the hole. The insert part or parts each have a through-opening extending along the central longitudinal axis or parallel to the central longitudinal axis of the insert part for guiding through an electrical or electronic line. The line can be arranged directly (line arranged directly in the through-opening) or indirectly in the through-opening (another element through which the line is guided is arranged in the through-opening).

This design makes it easy to produce a comparatively thin continuous channel (through-opening) for an electrical or electronic line in a penetrator, even if the penetrator or body is made of high-strength tungsten heavy metal (WHM). This favors the provision of a modern penetrator ("Smart Penetrator") that can be equipped with electrical properties. The line is largely protected from environmental influences due to the arrangement of the line in the through-opening of the insert part. This largely reduces the risk of the line being destroyed by powder during environmental tests, for example. By forming the comparatively thin through-opening in the insert part, problems that would occur when producing a long, comparatively thin hole directly in the penetrator (wear, accuracy) can be avoided. The properties of the penetrator can be adapted using one or more insert parts (multifunctional basic penetrator).

The line mentioned above can be a signal line. The line can be formed as a cable and can have for example one or more strands, each with insulation, and an optional sheath that surrounds the strands in their entirety.

The penetrator or the body (penetrator body) can be made of high-strength tungsten heavy metal (WHM). Irrespective of this, the penetrator can have a length of e.g., 100 to 1000 millimeters.

The hole formed in the body can have a diameter greater than 4 millimeters, but preferably significantly greater than 10 millimeters. The outer wall remaining on the body after forming the hole has a remaining wall thickness of at least 1 millimeter.

In a preferred embodiment, the insert part can be designed as an inner tube extending over the entire length of the hole. This contributes to a design of the penetrator having a small number of components. The inner tube is arranged in the body or penetrator body, wherein the outer circumference of the inner tube rests against the inner circumference of the hole in the body. The inner tube can be designed as a drawn tube, wherein the through-opening is also formed by "drawing." The inner tube can be made in particular of steel. The inner tube can have a comparatively high expansion capacity compared to the penetrator body.

Preferably, if the hole only extends over the predominant portion of the length of the body, the hole can be followed by a further hole. The further hole has a smaller diameter than the first hole (hole for receiving the at least one insert part), wherein the hole and the further hole together form a channel that completely penetrates the body. The first hole, which accommodates the insert(s), is therefore designed as a blind hole. The bottom of the blind hole thus forms a stop for the insert part(s). This makes it easier to position the insert parts in the hole. In addition, the insert parts are protected from falling out towards the bottom of the hole. In other words, this is a "partially enlarged hole", wherein the insert part or parts can be or are arranged in the "enlarged part" (first hole). The electrical or electronic line, which extends through the further hole and through the through-opening(s) in the insert parts, can be arranged in the "non-enlarged part" (further hole).

In an expedient manner, at least two cylinder blocks can be provided as insert parts, which are arranged adjacent to one another in the hole of the body or penetrator body. The cylinder blocks lie against each other and the through-openings of the cylinder blocks are aligned with each other. The aligned through-openings thus form a channel portion for the electrical or electronic line. Due to the comparatively short cylinder blocks compared to the length of the penetrator body, a through-opening can be easily formed in each of these to guide the electrical or electronic line, e.g., by drilling (the through-opening is formed as a hole in each case).

The cylinder blocks can each be designed as a vertical circular cylinder with a central through-opening for guiding the electrical or electronic line. The cylinder blocks can each have a length of 5 to 50 millimeters.

Preferably, the cylinder blocks can each be made of the same material. This allows identical mechanical behavior of the cylinder blocks to be achieved in practice. In addition, the material sourcing of the cylinder blocks can be simplified (only one material required) and the installation of the cylinder blocks can be simplified (sequence of the cylinder blocks may be irrelevant).

Optionally, the cylinder blocks can each have the same height (same cylinder block thickness) along their central longitudinal direction. This also contributes to a consistent mechanical behavior of the cylinder blocks. Identically dimensioned cylinder blocks also simplify their manufacture.

Alternatively, the cylinder blocks can each be made of a different material. As a result, the mechanical behavior of the cylinder blocks can be varied by selecting specific materials, e.g., by inserting cylinder blocks made of different materials along the hole or along the penetrator body.

Optionally, the cylinder blocks can each have a different height along their central longitudinal direction. The mechanical behavior of the cylinder blocks can be specifically varied by adjusting the height.

Advantageously, the cylinder blocks can be made of the same material as the body of the penetrator or of a different material. A design made of the same material favors a comparatively uniform mechanical behavior of the cylinder blocks with the penetrator body. Material sourcing is also simplified. The terminal ballistic behavior of the penetrator can be influenced by a design made of different materials, e.g., by a splintering effect when the cylinder blocks are made of a material with a lower density compared to the penetrator body.

In a preferred embodiment, a fitting threaded pin can be introduced into the through-openings of the cylinder blocks, wherein the threaded pin penetrates the cylinder blocks and has a hollow cross section (perpendicular to the longitudinal axis of the threaded pin). The threaded pin can be used to center the cylinder blocks. This can increase the terminal ballistic performance. In addition, the electrical or electronic line can be guided in the hollow cross section (hollow interior, open at the ends) of the threaded pin. The line is therefore not arranged directly in the through-opening, but indirectly, namely by being arranged in the threaded pin, which in turn is arranged in the through-opening or through-openings of the cylinder blocks. The through-openings of the cylinder blocks through which the threaded pin passes can each have an internal thread corresponding to the external thread of the threaded pin.

In an advantageous manner, of at least two of the cylinder blocks which are arranged directly adjacent to one another in the hole, a first of the cylinder blocks can have an extension projecting from the end face at one end and a second of the cylinder blocks can have an end-face recess corresponding to the extension at the end facing the first cylinder block, the extension being introduced into or engaging in the recess. This allows the cylinder blocks to be centered, which can achieve an increase in the terminal ballistic performance. Optionally, not only two, but multiple or possibly all the cylinder blocks arranged in the hole of the penetrator body can be equipped with an extension and/or a recess. This allows a further centering to be achieved so that the terminal ballistic performance can again be increased.

In an expedient manner, the first of the cylinder blocks and the second of the cylinder blocks can each have an extension projecting from the end face at one end and an end-face recess corresponding to the extension at the other end. This means that the first cylinder block and the second cylinder block each have an extension and a recess. This allows further centering and an increase in ballistic performance to be achieved. The first and second cylinder blocks can be designed identically so that production is simplified. Optionally, not only two, but multiple or possibly all cylinder blocks arranged in the hole of the penetrator body can each have an extension at one end and a recess corresponding to the extension at the other end. The cylinder blocks arranged at the end in the hole can optionally each have only one extension or only one recess so that there is a flat termination at each end.

Specifically, the extension and the recess can each be circular disk-shaped or conical. In other words, the extension and the recess can each have a circular disk shape or a conical shape. In a circular disk-shaped design, the extension can project centrally from the end face of the cylinder block, wherein the outer diameter of the extension is smaller than the outer diameter of the cylinder block. In a conical design, the extension can also project centrally from the end face of the cylinder block, wherein the conical contour tapers conically going from the outer circumference of the cylinder block towards the free end. Here as well the recess corresponds to the (conical) extension so that the extension can be introduced into the recess so as to fit.

Alternatively, the extension can be designed as an end-face profiling, wherein the recess is designed as an end-face counter-profiling corresponding to the profiling. A centering of cylinder blocks, which can increase the terminal ballistic performance, can also take place here. The resulting processing effort and material weakening at the cylinder blocks is comparatively low. The profiling can, for example, have concentric grooves, wherein the counter-profiling can have corresponding concentric grooves.

In a preferred embodiment, the hole can have an internal thread, wherein at least one of the cylinder blocks has (on its outer circumference or its lateral surface) an external thread corresponding to the internal thread. This enables a stable positioning of the cylinder block in the hole of the penetrator body and an appropriate centering to be achieved. This contributes to an increase in the terminal ballistic performance. Optionally, the internal thread of the hole of the penetrator body can be continuous. A plurality, or possibly all, of the cylinder blocks can have an external thread in the hole.

The object mentioned at the beginning is also achieved by using a penetrator with one or more of the above aspects to attack an armored target, in particular a tank. With regard to the advantages, reference is made to the statements made in this respect about the penetrator. For the further design, the measures described in connection with the penetrator and/or the measures explained below can be used.

The aforementioned object is also achieved by a projectile comprising a sabot, a tail unit, and a penetrator with one or more of the above aspects. With regard to the advantages, reference is made to the statements made in this respect about the penetrator. For the further design, the measures described in connection with the penetrator and/or the measures explained below can be used.

The above-mentioned object is also achieved by a cartridge ammunition comprising a projectile as described above and a cartridge case. With regard to the advantages, reference is made to the statements made in this respect about the penetrator. For the further design, the measures described in connection with the penetrator and/or the measures explained below can be used.

In a preferred embodiment, the electrical or electronic line can be guided from the base of the cartridge case to the tip of the cartridge case. This allows the penetrator or the cartridge ammunition to be equipped with electrical or electronic properties. The line is guided through the through-openings formed in the insert parts or cylinder blocks and, if necessary, through the further hole in the cylinder block. The line can be designed as described above.

BRIEF DESCRIPTION OF DRAWINGS

The invention is explained in more detail below with reference to the figures, wherein identical or functionally identical elements are provided with identical reference signs, but, where applicable, only once. In the drawings.

DETAILED DESCRIPTION

Figure 1:
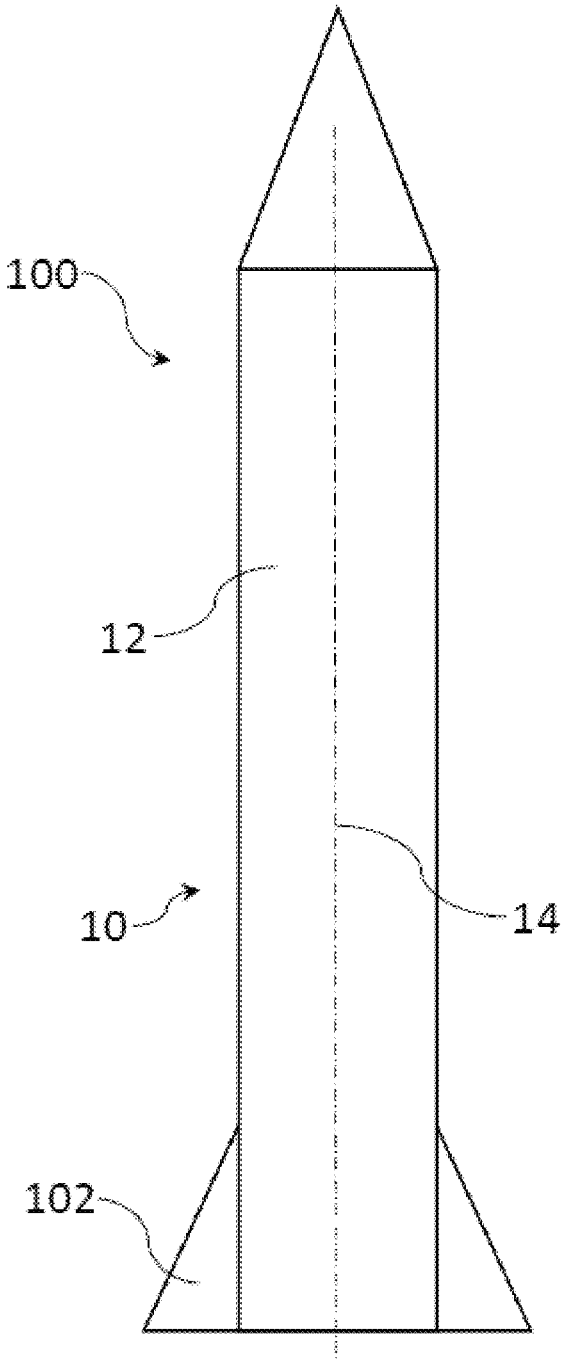
FIG. 1 shows a schematic side view of an embodiment of a penetrator.

FIG. 1 shows a schematic side view of a penetrator which is designated as a whole by reference sign 10. The penetrator 10 is designed for a projectile 100 with a tail unit 102.

The penetrator 10 also has a terminal ballistic body or penetrator body 12 for attacking an armored target (not shown). The central longitudinal axis of the body 12 is designated by reference sign 14. A hole 16 is formed in the body 12, which hole in the example extends along the central longitudinal axis 14 of the body 12, namely over the predominant portion of the length of the body 14 (cf. FIG. 2*a*). The hole 16 is formed by means of a drilling tool 18 (shown only schematically). In an alternative embodiment, the hole 16 can extend over the entire length of the body 12, i.e., penetrate it completely (indicated by dashed lines 20).

Figure 2A:
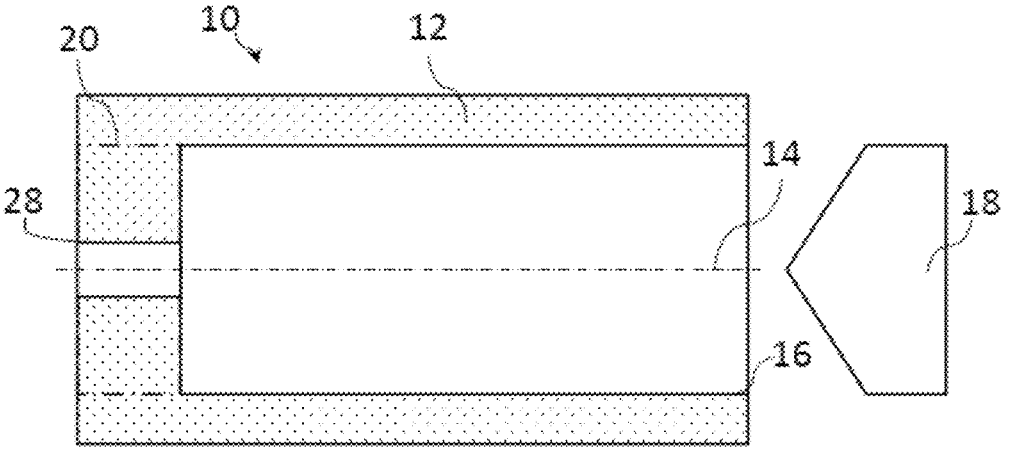
FIGS. 2*a*, 2*b* and 2*c* show partial sectional views of the penetrator of FIG. 1 after forming the hole (FIG. 2*a*), introducing the insert parts (FIG. 2*b*), and introducing the electrical or electronic line (FIG. 2*c*)
Figure 2B:
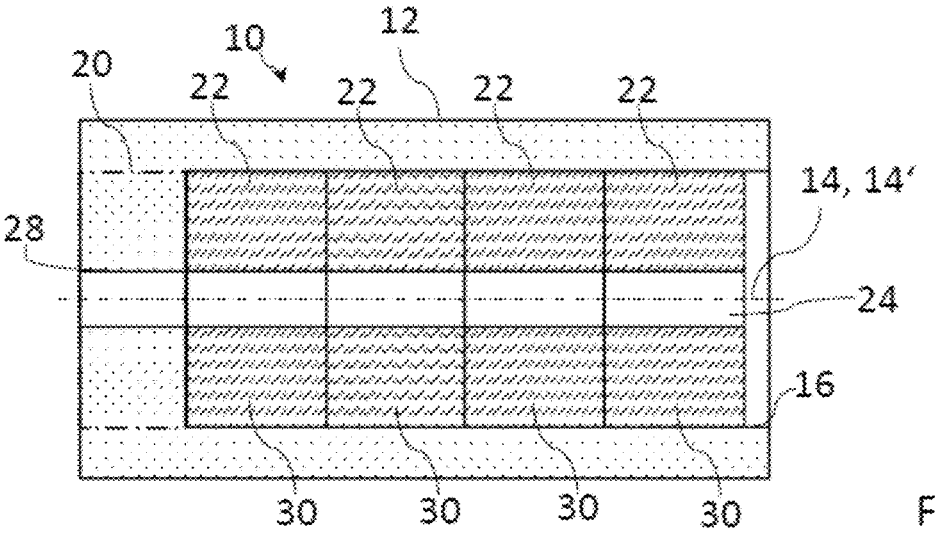
Figure 2C:
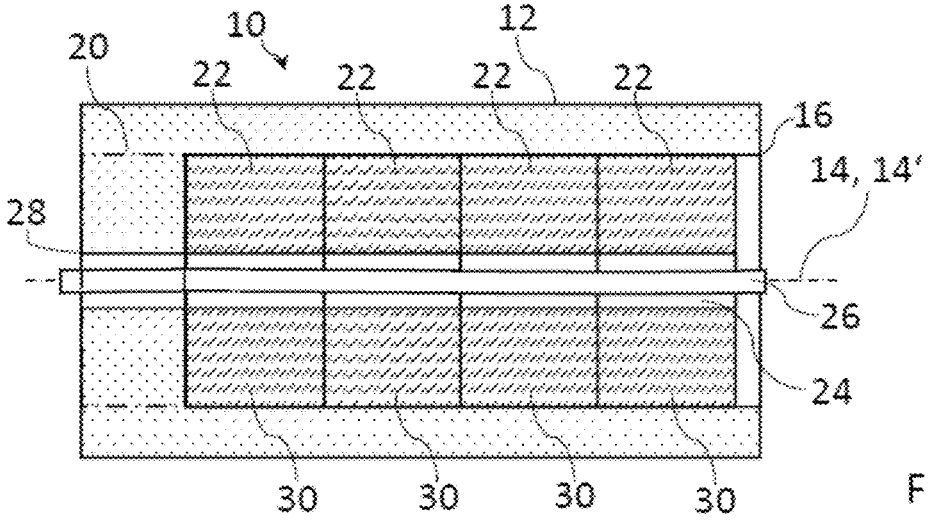

At least one exactly fitting insert part 22 is introduced into the hole 16 (see FIG. 2*b*), which in the example has a through-opening 24 extending along the central longitudinal axis 14' of the insert part 22 for guiding through an electrical or electronic line 26 (cf. FIG. 2*c*).

In the example, four insert parts 22 are introduced into the hole 16 (cf. FIGS. 2*b* and 2*c*). In the example, the line 26 is routed directly through the through-openings 24 of the insert parts 22 and can be designed as described above.

In the example, the hole 16 extends only over the predominant portion of the length of the body 12 (cf. FIG. 2*a* to 2*c*). The hole 16 is followed by a further hole 28, which has a smaller diameter than the hole 16. The hole 16 and the further hole 28 together form a channel (with portions having different diameters) that completely penetrates the body 12 (cf. FIG. 2*a*). Since in the example the line 26 extends through the through-openings 24 of the insert parts 22 and through the further hole 28, the diameter of the further hole 28 is dimensioned such that the line 26 can be guided through the further hole.

In the example, four cylinder blocks 30 are provided as insert parts 22, which are arranged one after the other in the hole 16, wherein the cylinder blocks 30 abut one another and the through-openings 24 of the cylinder blocks 30 are aligned with one another. Thus, the through-openings 24 form a channel portion which is aligned with the further hole 28, so that the line 26 can be guided through the body 12 in it.

In the example, the cylinder blocks 30 are each made of the same material and have the same height along their central longitudinal direction 14'. As already explained above, it is also conceivable for the cylinder blocks to be made of different materials and/or to have a different height along their central longitudinal direction 14'. It has also already been discussed that the cylinder blocks 30 can be made of the same material as the body 12 of the penetrator 10 or of a different material.

Figure 3:
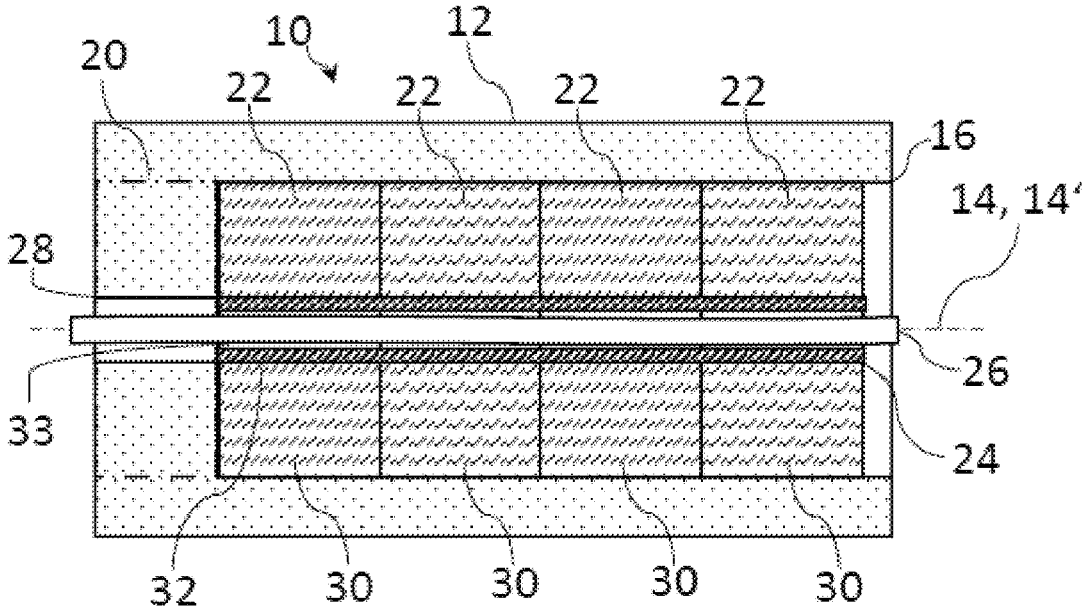
FIG. 3 shows a possible design of the penetrator of FIG. 1 with centering by means of a threaded pin, in a partial sectional view.

FIG. 3 shows an embodiment of the penetrator 10 that largely corresponds to the embodiment described with reference to FIGS. 1 and 2. To avoid repetition, reference is therefore made to the explanations there.

In the present embodiment, a centering takes place of the cylinder blocks 30 arranged in the hole 16. For this purpose, a fitting threaded pin 32 is introduced into the through-openings 24 of the cylinder blocks 30. The threaded pin 32 penetrates the cylinder blocks 30 and has (perpendicular to the longitudinal axis of the threaded pin 32) a hollow cross section with a hollow interior 33. The hollow interior 33 extends completely through the threaded pin 32, wherein the threaded pin 32 is open at each end. The line 26 is guided through the hollow interior 33 and through the further hole 28. The line 26 is thus arranged indirectly in the through-openings 24 of the cylinder blocks 30, because the line is accommodated in the threaded pin 32.

Figure 4:
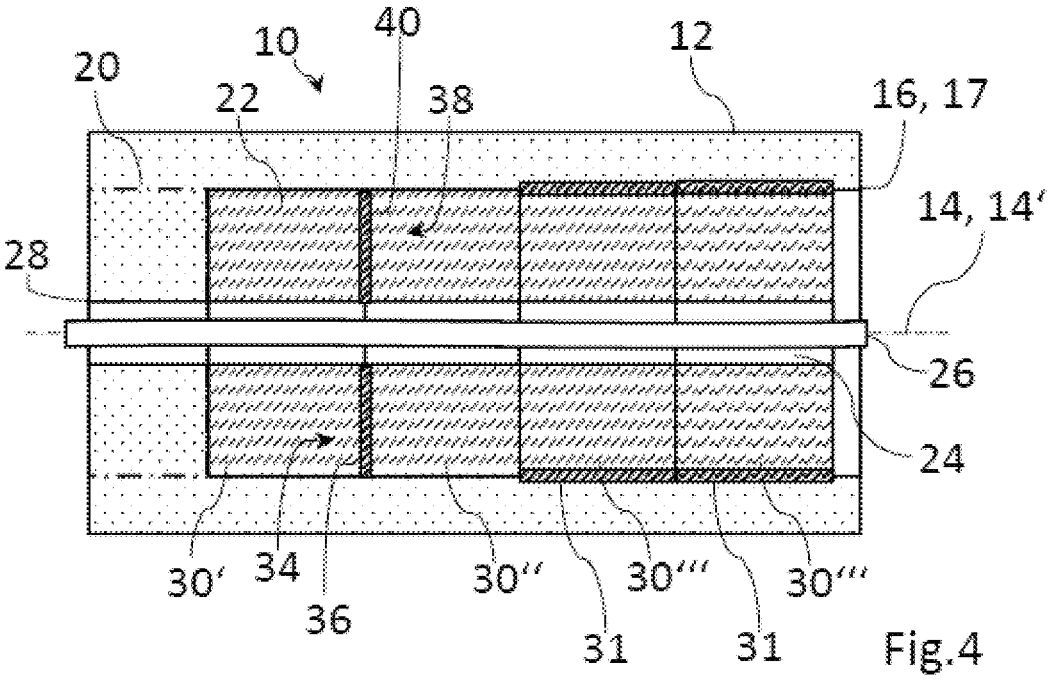
FIG. 4 shows a possible design of the penetrator of FIG. 1 with centering by means of profilings or threads, in a partial sectional view.

FIG. 4 shows a further embodiment of the penetrator 10, which largely corresponds to the embodiment described with reference to FIGS. 1 and 2. To avoid repetition, reference is therefore made to the explanations there.

Of at least two of the cylinder blocks 30, which are arranged directly adjacent to one another in the hole 16, a first cylinder block 30' has at one end 34 an extension 36 projecting from the end face and a second cylinder block 30" has an end-face recess 40 corresponding to the extension 36 at the end 38 facing the first cylinder block 30', wherein the extension 36 is introduced into the recess 40 (shown only schematically). In the example, the extension 36 is formed as a profiling on the end face. The recess 40 is formed as an end-face counter-profiling corresponding to the profiling. The profiling and counter-profiling can be formed as described above.

Alternatively or additionally, the hole 16 can have an internal thread 17, wherein at least one of the cylinder blocks 30'" has an external thread 31 corresponding to the internal thread 17.

Figure 5:
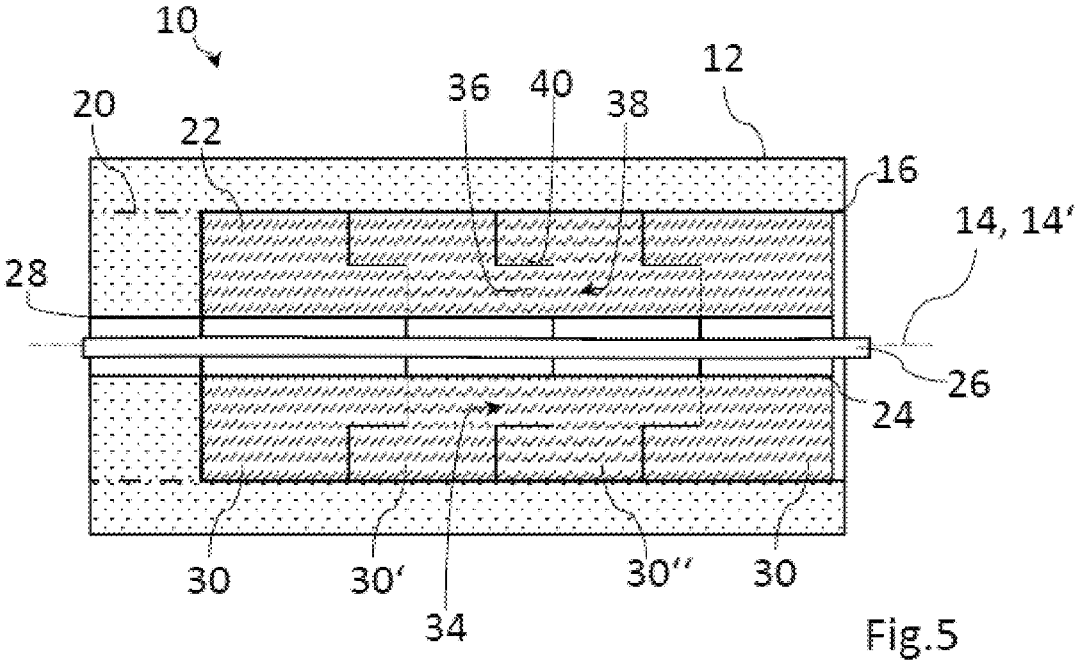
FIG. 5 shows a partial sectional view of a possible embodiment of the penetrator of FIG. 1 with centering via circular disk-shaped extensions or recesses.

FIG. 5 shows a further embodiment of the penetrator 10, which largely corresponds to the embodiment described with reference to FIGS. 1 and 2. To avoid repetition, reference is therefore made to the explanations there.

Here as well, of at least two of the cylinder blocks 30, which are arranged directly adjacent to one another in the hole 16, a first cylinder block 30' has at one end 34 an extension 36 projecting from the end face and a second cylinder block 30" has an end-face recess 40 corresponding to the extension 36 at the end 38 facing the first cylinder block 30', wherein the extension 36 is introduced into the recess 40.

In the example, the first cylinder block 30' and the second cylinder block 30" each have an extension 36 projecting from the end face at one end 34 and an end-face recess 40 corresponding to the extension 36 at the other end 38 (designated only once with reference signs in FIG. 5 for clarity).

The extension 36 and the recess 40 each have a circular disk shape. The extension 36 protrudes in each case centrally from the end face of the cylinder block 30', 30", wherein the outer diameter of the extension 36 is smaller than the outer diameter of the cylinder block 30', 30". The recess 40 is designed to correspond to the (circular disk-shaped) extension 36, so that the extension 36 can be introduced into the recess 40 with a fit.

The cylinder blocks 30 arranged at the edge in the hole 16 can optionally have no recess (cylinder block 30 in FIG. 5 in the hole 16 at far left) or no extension (cylinder block 30 in FIG. 5 in the hole 16 at far right) at the respective end of the hole 16.

Figure 6:
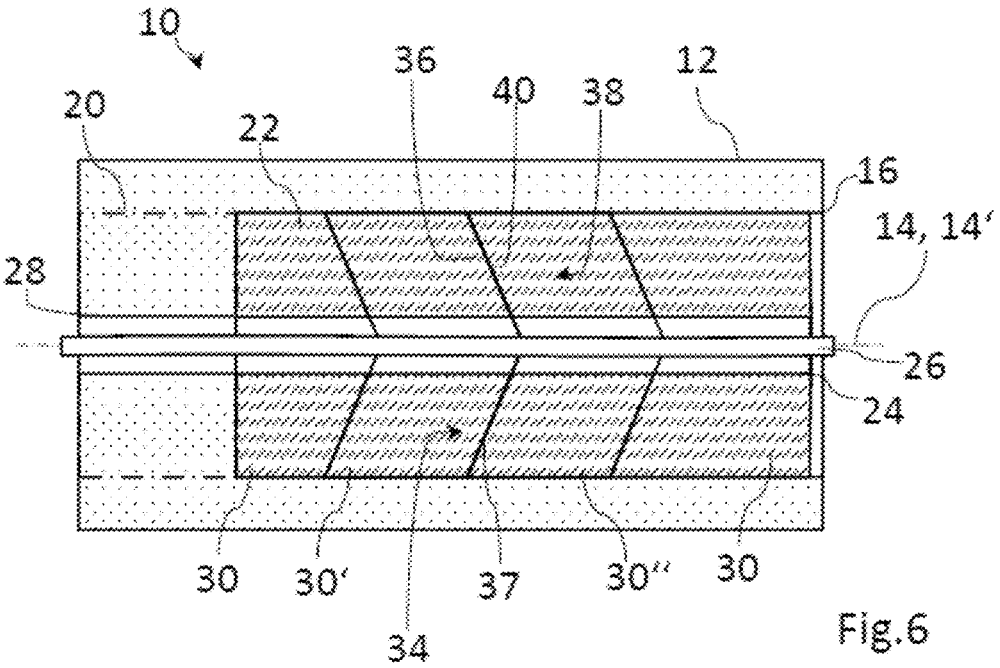
FIG. 6 shows a possible embodiment of the penetrator of FIG. 1 with centering via conical extensions or recesses, in a partial sectional view.

FIG. 6 shows a further embodiment of the penetrator 10, which largely corresponds to the embodiment described with reference to FIGS. 1 and 2. To avoid repetition, reference is therefore made to the explanations there.

Here as well, of at least two of the cylinder blocks 30, which are arranged directly adjacent to one another in the hole 16, a first cylinder block 30' has at one end 34 an extension 36 projecting from the end face and a second cylinder block 30" has an end-face recess 40 corresponding to the extension 36 at the end 38 facing the first cylinder block 30', wherein the extension 36 is introduced into the recess 40.

In the example, the first cylinder block 30' and the second cylinder block 30" each have an extension 36 projecting from the end face at one end 34 and an end-face recess 40 corresponding to the extension 36 at the other end 38 (designated only once with reference signs for clarity). The extension 36 and the recess 40 are each conical in shape. The extension 36 protrudes centrally in each case from the end face of the cylinder block 30', 30", wherein the conical contour 37 tapers conically going from the outer circumference of the cylinder block 30 towards the free end of the extension 36. The recess 40 corresponds to the conical extension 36, so that the extension 36 can be introduced into the recess 40 with a fit.

The cylinder blocks 30 arranged at the edge in the hole 16 can optionally have no recess (cylinder block 30 in FIG. 6 in the hole 16 at far left) or no extension (cylinder block 30 in FIG. 6 in the hole 16 at far right) at the respective end of the hole 40.

Figure 7:
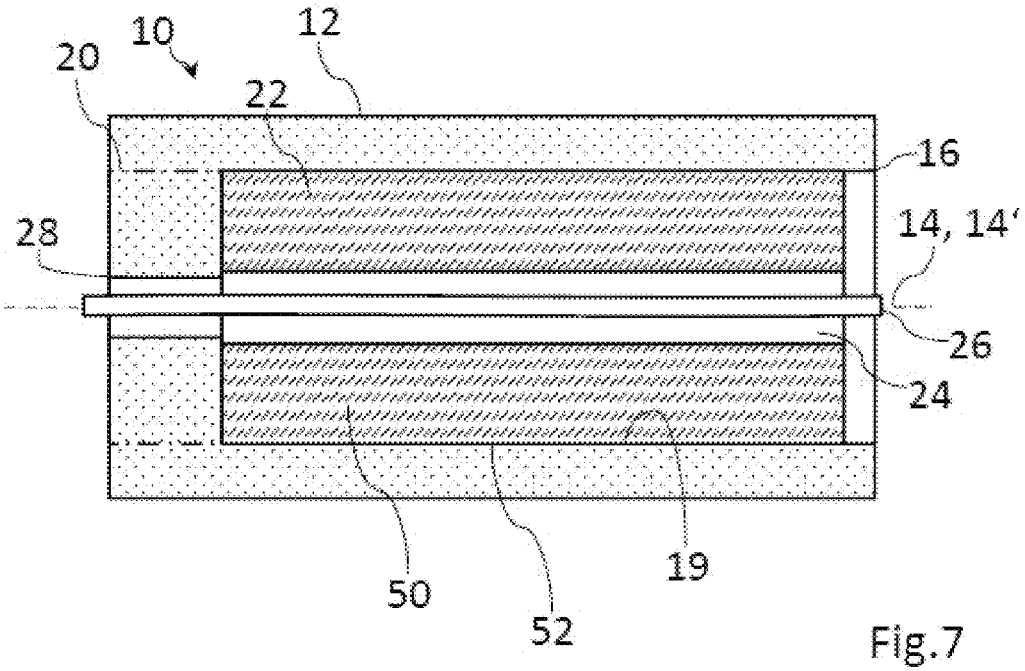
FIG. 7 shows a partial sectional view of the penetrator of FIG. 1 with centering via an inner tube extending in the hole.

FIG. 7 shows an embodiment of the penetrator 10 with only one insert part 22.

The penetrator 10 also has a terminal ballistic body or penetrator body 12 for attacking an armored target (not shown). The central longitudinal axis of the body 12 is designated by reference sign 14. A hole 16 is formed in the body 12, which hole in the example extends along the central longitudinal axis 14 of the body 12, namely over the predominant portion of the length of the body 14. The hole 16 is formed using a drilling tool (not shown). In an alternative embodiment, the hole 16 can extend over the entire length of the body 12, i.e., penetrate it completely (indicated by dashed lines 20).

An exactly fitting insert part 22 is introduced into the hole 16, which part in the example has a through-opening 24 extending along the central longitudinal axis 14' of the insert part 22 for guiding through an electrical or electronic line 26.

In the example, the insert part 22 is designed as an inner tube 50 extending over the entire length of the hole. The inner tube 50 is arranged in the body 12, wherein the inner tube 50 rests with its outer circumference 52 on the inner circumference 19 of the hole 16 of the body 12. The inner tube can be made in particular of steel.

In the example, the hole 16 only extends over the predominant portion of the length of the body 12. The hole 16 is followed by a further hole 28, which has a smaller diameter than the hole 16. The other hole 28 and the through-opening 24 of the insert 22 are aligned with each other. The line 26 is guided through the through-opening 24 and the further hole 28.

LIST OF REFERENCE NUMBERS

10 Penetrator
12 Body, penetrator body
14, 14' Central longitudinal axis
16 Hole
17 Internal thread
18 Drilling tool
19 Inner circumference
20 Continuous hole (dashed lines)
22 Insert part
24 Through-opening
26 Line
28 Further hole
30 Cylinder block
31 Outer thread
32 Threaded pin
33 Interior
34 End
36 Extension
37 Cone contour
38 Facing end
40 Recess
50 Inner pipe
52 Outer circumference

What is claimed is:

1. A penetrator for a projectile, comprising: a terminal-ballistic body for attacking an armored target, wherein a hole is formed in the body, which extends along or parallel to the central longitudinal axis of the body entirely or along a predominant portion of the length of the body, wherein at least one exactly fitting insert part is introduced into the hole, which has a through-opening extending along or parallel to the central longitudinal axis of the insert part, and wherein an electrical or electronic line is guided through the through-opening.

2. The penetrator according to claim 1, wherein the insert part is designed as an inner tube extending over the entire length of the hole.

3. The penetrator according to claim 1, wherein, if the hole extends only over the predominant part of the length of the body, the hole is adjoined by a further hole which has a smaller diameter than the hole, wherein the hole and the further hole together form a channel which completely penetrates the body.

4. The penetrator according to claim 1, wherein at least two cylinder blocks are provided as insert parts, which are arranged adjacent to one another in the hole, wherein the cylinder blocks rest against one another and the through-openings of the cylinder blocks are aligned with one another.

5. The penetrator according to claim 4, wherein the cylinder blocks are each made of the same material and/or each have the same height along their central longitudinal direction.

6. The penetrator according to claim 4, wherein the cylinder blocks are each made of different material and/or have a different height along their central longitudinal direction.

7. The penetrator according to claim 4, wherein the cylinder blocks are made of the same material as the body of the penetrator or of a different material.

8. The penetrator according to claim 4, wherein a fitting threaded pin is introduced into the through-openings of the cylinder blocks, the threaded pin penetrating the cylinder blocks and having a hollow cross section.

9. The penetrator according to claim 4, wherein, of at least two of the cylinder blocks, which are arranged directly adjacent to one another in the hole, a first cylinder block has at one end an extension projecting from the end face and a second cylinder block has at the end facing the first cylinder block an end-face recess corresponding to the extension, wherein the extension is introduced into the recess.

10. The penetrator according to claim 9, wherein the first of the cylinder blocks and the second of the cylinder blocks each have at one end an extension projecting from the end face and at the other end an end-face recess corresponding to the extension.

11. The penetrator according to claim 9, wherein the extension and the recess are each circular disc-shaped or conical.

12. The penetrator according to claim 9, wherein the extension is designed as an end-face profiling, the recess being designed as an end-face counter-profiling corresponding to the profiling.

13. The penetrator according to claim 4, wherein the hole has an internal thread, wherein at least one of the cylinder blocks has an external thread corresponding to the internal thread.

14. A method of using a penetrator, comprising:

attacking an armored target with the penetrator of claim 1.

15. A projectile comprising a sabot, a tail unit and the penetrator according to claim 1.

16. A cartridge ammunition comprising the projectile according to claim 15 and a cartridge case.

17. The cartridge ammunition according to claim 16, wherein the electrical or electronic line is guided from a base of the cartridge case to a tip of the cartridge case through the through-opening.

* * * * *